US011319677B2

(12) United States Patent
Swanson et al.

(10) Patent No.: US 11,319,677 B2
(45) Date of Patent: May 3, 2022

(54) HI-RECYCLE ASPHALT BATCH PLANT

(71) Applicant: Astee, Inc., Chattanooga, TN (US)

(72) Inventors: Malcolm Leland Swanson, Chickamauga, GA (US); Greg Renegar, Ooltewah, TN (US); Michael Varner, East Ridge, TN (US); Earl Edwards, Jr., Trenton, GA (US)

( * ) Notice: Subject to any disclaimer, the term of this patent is extended or adjusted under 35 U.S.C. 154(b) by 0 days.

(21) Appl. No.: 17/337,608

(22) Filed: Jun. 3, 2021

(65) Prior Publication Data

US 2021/0381175 A1 Dec. 9, 2021

Related U.S. Application Data

(60) Provisional application No. 63/035,306, filed on Jun. 5, 2020.

(51) Int. Cl.

| | |
|---|---|
| ***E01C 19/00*** | (2006.01) |
| ***E01C 19/10*** | (2006.01) |
| ***E01C 19/05*** | (2006.01) |

(52) U.S. Cl.

CPC ..... *E01C 19/104* (2013.01); *E01C 19/05* (2013.01); *E01C 19/1072* (2013.01); *E01C 19/1077* (2013.01); *E01C 19/1004* (2013.01)

(58) Field of Classification Search

CPC .... E01C 19/104; E01C 19/05; E01C 19/1072; E01C 19/1077; E01C 19/1004

See application file for complete search history.

(56) References Cited

U.S. PATENT DOCUMENTS 5,378,059 A * 1/1995 Brock ..... B09C 1/06 366/25

2019/0255534 A1* 8/2019 Shelton, Jr. ..... B01F 7/00508

* cited by examiner

*Primary Examiner* — Anshu Bhatia

(57) ABSTRACT

A method for producing an asphalt concrete blend that includes the steps of drying and heating aggregate in a single and only dryer, preferably via direct heating, and without use of a pre-dryer. The aggregate is then combined with asphalt cement, preferably via indirect heating, such that the blend has an asphalt cement components (ACC) percentage of at least 25% percent to form an aggregate mix. Liquid asphalt cement may also be added to the aggregate mix. Preferably, the asphalt cement content of the final asphalt concrete blend is provided by a maximum of 70% ACC. In certain cases, the asphalt cement content of the asphalt concrete blend is comprised of ACC and liquid asphalt cement.

17 Claims, 7 Drawing Sheets

HI-RECYCLE ASPHALT BATCH PLANT

CROSS-REFERENCE TO RELATED APPLICATIONS

This application claims the benefit of U.S. Provisional Application No. 63/035,306 filed Jun. 5, 2020, and entitled HI-RECYCLE ASPHALT BATCH PLANT, which is incorporated herein by reference in its entirety.

FIELD

The present invention relates generally to the production of asphalt concrete using aggregate materials that may include a high proportion of recycled materials. More particularly, the present invention relates to a method and apparatus for making asphalt concrete from aggregate materials including a relatively high percentage of recycled asphalt product ("RAP") and/or recycled asphalt shingles ("RAS").

BACKGROUND

Production facilities for making asphalt concrete to be used as a paving composition are well-known. Feed materials for these facilities include aggregate materials and asphalt cement. The aggregate materials may be provided in the form of virgin aggregate materials and/or RAP and/or RAS (where RAP and RAS are referred to, collectively, as "Asphalt Cement Components" or "ACC"). If ACC is included in the feed materials, these components will also provide an additional source of asphalt cement.

Some conventional asphalt concrete production plants employ a rotating dryer drum or pre-dryer in which virgin aggregate materials or ACC are introduced. A burner is located at one end of the drum and the input feed materials are moved along the drum through the heated gases generated by the burner in either parallel flow or counter-current flow to an outlet. A separate mixer that is external to the dryer, such as a rotating drum mixer or a pugmill, is employed to combine the aggregate materials with liquid asphalt cement. Another type of asphalt concrete production plant employs a dryer that dries and heats the aggregate material and also mixes it with asphalt cement. One such type of dryer is the DOUBLE BARREL® brand dryer that is sold by Astec, Inc. of Chattanooga, Tenn. This dryer includes a generally cylindrical fixed outer drum and a heating chamber located within a generally cylindrical inner drum that is adapted to rotate with respect to the outer drum. A burner at one end of the inner drum heats aggregate material by direct exposure to the hot gases generated, and the heated aggregate material is discharged from the inner drum into the outer drum where it is mixed with asphalt cement and/or with ACC. If substantial quantities of ACC are introduced into the DOUBLE BARREL® brand dryer, a mixer, such as a pugmill or mixing drum, may also be employed to add and incorporate additional asphalt cement into the mixture.

Because some conventional systems expose liquid asphalt cement or ACC materials to the high-temperature gases used for drying and heating the aggregate materials and to the steam generated in the drying process, emissions of smoke and volatile organic compounds ("VOCs") are stripped from the light oil fractions of the ACC. In order to prevent these emissions from being discharged to the atmosphere, it has been deemed desirable, when only virgin aggregate materials are used, to either direct the emissions into the burner for incineration, or to filter the emissions from the plant exhaust gases and condense them for disposal. In addition, exposure of high proportions of ACC materials to the high temperatures from the drying and heating of aggregate materials combined with oxygen causes oxidation of the liquid asphalt in the ACC, which degrades the asphalt cement component and any pavement materials made with it. This reduces the number of applications for which high-ACC percentage asphalt concrete is considered suitable. Finally, conventional equipment that is used to make high ACC percentage asphalt concrete, particularly those without a pre-dryer, are operated at a lower production rate than when the same equipment is used to make asphalt concrete with only small amounts of ACC or with all virgin aggregate materials or when a pre-dryer is utilized.

With initial reference to FIGS. 1-3, there is provided a batch plant 100 that is conventionally used for producing asphalt concrete from aggregate materials that include a high percentage of ACC. The plant 100 includes counter-flow aggregate dryer 102, pre-dryer 104, and bag house 106. An aggregate elevator 108 conveys virgin aggregate material from dryer 102 to screen deck 110 within batch tower 112. The virgin aggregate material then passes through screen deck 110 to arrive at mixer/pugmill 114, which is also located within the batch tower 112. Elevator 116 conveys ACC to pre-dryer 104. Heated ACC is conveyed from pre-dryer 104 to batch tower 112, into a surge bin 118 and weigh system 120, and then to the mixer/pugmill 114, where the ACC is mixed with virgin aggregate material. The ACC and dried virgin aggregate material may also be mixed with asphalt cement that is provided from a separate source in mixer/pugmill 114 before being deposited in truck 122 or other means of transport for mixed asphalt material. Combustion products and exhaust gases generated during the operation of dryer 102 are conveyed to pre-dryer 104 by exhaust gas conduit 126. In other embodiments of a prior art plant, the pre-dryer may be heated indirectly by a thermal heating fluid. It is also possible to operate dryer 102 without also operating pre-dryer 104 by using bypass conduit 128 to direct the combustion products and warm exhaust gases from the exhaust gas conduit 126 to bag house conduit 130 and from there to bag house 106.

The batch plant 100 also includes stairs 124, which are frequently used by personnel to access various sections of the batch tower 112 during asphalt production, for inspections and maintenance of the batch tower, etc. As shown by the above discussion, certain ACC batch plants utilize pre-dryers, such as pre-dryer 104, to assist in the drying and heating process of ACC. These dryers are often direct-fired rotary dryers that are dedicated exclusively to heating and drying ACC. They are typically located at the top of the batch tower while, at the same time, a second conventional aggregate dryer, such as dryer 102, is located on ground level for drying and heating virgin aggregate. ACC pre-dryers require frequent maintenance. One reason for this maintenance is that the interior of these pre-dryers can accumulate large amounts of ACC fines and oxidized asphalt as a result of the direct firing process. The ACC fines and oxidized asphalt can catch on fire if not removed regularly. Additionally, ACC fines tend to become trapped in recirculation patterns around the burner and to stick to and foul the burner. This, again, requires periodic removal. This type of maintenance must be carried out manually by personnel at the top of the batch tower. However, due to the elevated location of the pre-dryer at the top of the batch tower, access for inspection, maintenance, etc. is labor intensive, requiring frequent trips up and down the stairs 124, and can be quite difficult. It would be much easier to carry out this type of maintenance work at ground level.

What is needed, therefore, is a method and apparatus for producing asphalt concrete from aggregate materials include a high percentage of ACC that utilizes a single dryer to dry and heat both virgin aggregate as well as blends of ACC and virgin aggregate, and does not utilize a second separate pre-dryer that is dedicated only to heating and drying ACC. It would also be desirable if the single dryer were located at ground level to facilitate periodic maintenance.

NOTES ON CONSTRUCTION

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context.

Terms concerning attachments, coupling and the like, such as "connected" and "interconnected", refer to a relationship wherein structures are secured or attached to one another either directly or indirectly through intervening structures, as well as both moveable and rigid attachments or relationships, unless otherwise specified herein or clearly indicated by context as having a different relationship. The term "operatively connected" is such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity.

Various terms are specifically defined herein. These terms are to be given their broadest possible construction consistent with such definitions, as follows:

The term "asphalt cement components percentage" and "ACC percentage" and similar terms refer to the proportion, by weight, of asphalt cement components (i.e., ACC) provided in an asphalt concrete blend as a percentage of the entire asphalt concrete blend.

The term "aggregate materials" and similar terms refer to crushed stone and other particulate materials that are used in the production of asphalt concrete, such as, for example, crushed limestone and other types of crushed stone, crushed Portland cement concrete, shredded or comminuted mineral and cellulosic fibers, RAP, RAS, gravel, sand, lime and other particulate additives. The term "virgin aggregate materials" refers to aggregate materials that do not include asphalt cement. The term "aggregate mix" refers to a mixture of virgin aggregate and RAP and/or RAS.

The term "asphalt concrete" and similar terms refer to a bituminous paving mixture that is produced, using asphalt cement and/or RAP and/or RAS and any of various aggregate materials, in an asphalt dryer or other asphalt concrete production plant.

The term "asphalt cement" and similar terms refer to a bituminous material that may be used in combination with aggregate materials in the production of asphalt concrete. Asphalt cement acts as the binder for various aggregate materials in the production of asphalt concrete.

As used herein, the term "baghouse" refers to any structure adapted to trap solids that have temporarily combined with gases.

As used herein, the term "burner" refers to any device adapted to produce a burner flame which may be used to dry and heat virgin aggregates, RAP, RAS and the like in connection with the production of asphalt concrete blends.

The term "direct dryer", "direct fired dryer" and similar terms refer to a dryer or dryer device having a burner, generally located at one end, which device is adapted to move input feed materials to be heated or dried along the device through the heated gases generated by the burner in either parallel flow or counter-current flow to an outlet. "Direct" drying or heating of materials is carried out by moving such materials directly through a burner flame or heated gases generated by a burner.

The term "high" and "Hi", when used to refer to the percentage of ACC, RAP, or RAS provided in a given asphalt concrete blend (e.g., Hi-RAP), means that the blend, as a whole, is comprised of a minimum of 25% of ACC, RAP, or RAS.

The term "indirect dryer", "indirectly heated pre-dryer" and similar terms refer to a dryer or dryer device which is adapted to dry or heat input feed materials without such materials coming into direct contact with a burner flame or heated gases generated by a burner. "Indirect" drying or heating of materials is carried out without such materials coming into direct contact with a burner flame or heated gases generated by a burner.

As used herein, the terms "liquid asphalt cement" and "liquid AC" and "AC" refer to a substance or material used in combination with virgin aggregates, RAP, RAS and the like in connection with the production of asphalt concrete blends. More particularly, the terms "liquid asphalt cement" and "liquid AC" and "AC" refer to any substance or material that has the characteristic of forming a cohesive relationship between virgin aggregates, RAP, RAS and the like for the purpose of producing asphalt concrete blends.

As used herein, the term "pugmill" refers to any device adapted to combine materials such as virgin aggregates, RAP, RAS, liquid asphalt cement and the like to produce asphalt concrete blends.

The terms "recycled asphalt product", "RAP" and similar terms refer to a comminuted or crushed product containing aggregate materials bound together by asphalt cement. RAP typically comprises crushed or comminuted recycled asphalt paving materials.

The terms "recycled asphalt shingles", "RAS" and similar terms generally refers to crushed, shredded or comminuted asphalt roofing shingles or asphalt cement-containing products other than RAP. However, throughout this specification, the term "RAP" or the term "ACC" (i.e., asphalt cement components) may be used to refer to either RAP or RAS, or both unless otherwise specifically noted.

As used herein, the term "scalping screen" refers to any device adapted to remove oversized materials such as trash, debris and the like from virgin aggregates, RAP, RAS and the like.

SUMMARY

The above and other problems are addressed by a plant configured for the batch production of an asphalt concrete blend having a high percentage of ACC of at least 25% percent. The plant includes a single and only dryer for mixing and for carrying out all drying operations required in producing the asphalt concrete blend by the plant. The dryer is provided with a generally cylindrical fixed outer drum, a generally cylindrical rotating inner drum positioned inside of and configured to rotate within the outer drum, and a burner directing a flame in a generally axial direction into a heating chamber within the inner drum. A mixing chamber is formed between an outer surface of the inner drum and an internal surface of the outer drum that is in selective communication with the heating chamber to either prevent aggregate from passing from the heating chamber to the mixing chamber in a first mode of operation or to enable aggregate to pass from the heating chamber to the mixing chamber in a second mode of operation. A plurality of mixing paddles is located within the mixing chamber that are sized and configured to combine virgin aggregate and ACC and/or liquid asphalt cement within the mixing chamber. The dryer also includes an ACC chute through which ACC may be passed into the mixing chamber and an aggregate chute through which aggregate may be passed into the inner drum. In certain embodiments of the invention, the plant includes a frame that is sized and configured to mount the dryer at ground level and at an angled orientation in order to provide an upper end and a lower end that is vertically lower than the upper end. Preferably, the ACC chute is located at the lower end of the dryer and the aggregate chute is located at the upper end of the dryer. In certain embodiments of the invention, a slide gate is located on the dryer that is movable between a closed position, wherein the dryer operates in the first mode of operation and virgin aggregate exits the dryer after being dried and heated but without being mixed in the mixing chamber, and an open position, wherein the dryer operates in the second mode of operation and virgin aggregate passes from the inner drum through open slide gate and into the mixing chamber. In certain embodiments of the invention, the plant includes a source of liquid asphalt cement and a secondary mixer that is external to the dryer that is configured to receive virgin aggregate or aggregate mix from the single and only dryer, to receive liquid asphalt cement from the liquid asphalt cement source, and to combine the virgin aggregate or aggregate mix with liquid asphalt cement in forming the asphalt concrete blend.

The present disclosure also provides a method for producing an asphalt concrete blend that includes the steps of drying and heating aggregate in a single and only dryer without use of a pre-dryer and then combining asphalt cement with the aggregate such that the asphalt concrete blend has an asphalt cement components (ACC) percentage of at least 25% percent. In certain embodiments, the method includes the step of adding liquid asphalt to the aggregate, wherein all of the liquid asphalt of the asphalt concrete blend is added to the aggregate after the aggregate is dried and heated by the single and only dryer. In certain cases, the liquid asphalt is added in a mixer that is external to the dryer. In certain cases, the liquid asphalt is added in a batch tower that is external to the dryer. Preferably, the asphalt cement content of the asphalt concrete blend is provided by a maximum of 70% ACC. In certain embodiments, the asphalt concrete blend is comprised of ACC and liquid asphalt cement. In preferred embodiments, the aggregate is dried and heated via direct drying and heating in a first portion of the single and only dryer. Thereafter, the aggregate is combined with ACC to form an aggregate mix that is then heated via indirect heating in a second portion of the single and only dryer. Furthermore, in certain embodiments, the aggregate mix is then combined with liquid asphalt cement to form the final asphalt concrete blend.

The present disclosure also provides a method for producing asphalt concrete blends that includes the step of providing a dryer having a fixed outer drum, a rotating inner drum positioned inside of and configured to rotate within the outer drum, a burner directing a flame into a heating chamber within an interior of the inner drum, and a mixing chamber formed between an outer surface of the inner drum and an internal surface of the outer drum. A slide gate located on the dryer is movable between a closed position when the dryer operates in a first mode of operation, wherein aggregate located within the heating chamber is prevented from passing into the mixing chamber, and an open position when the dryer operates in a second mode of operation, wherein aggregate located within the heating chamber is permitted to pass into the mixing chamber. A plurality of mixing paddles located within the mixing chamber that are sized and configured to mix aggregate located within the mixing chamber. The method also includes the steps of heating and drying first aggregate within the heating chamber and then combining the first aggregate with asphalt cement to form a first asphalt concrete blend. Certain embodiments of the method further include the step of providing a mixer and, with the dryer in the first mode of operation, combining the first aggregate with the asphalt cement in the mixer to form the first asphalt concrete blend. According to certain embodiments of the invention, with the dryer in the second mode of operation, the first aggregate is combined with the asphalt cement in the mixing chamber to form the first asphalt concrete blend. In some embodiments, the asphalt cement includes ACC. In some embodiments, the asphalt cement is liquid asphalt cement. In certain of those cases, the method further includes the step of providing a mixer and combining the first asphalt concrete blend with liquid asphalt in the mixer to form a second asphalt concrete blend.

BRIEF DESCRIPTION OF THE DRAWINGS

Further advantages of the invention are apparent by reference to the detailed description when considered in conjunction with the figures, which are not to scale so as to more clearly show the details, wherein like reference numerals represent like elements throughout the several views, and wherein.

DETAILED DESCRIPTION

This description of the preferred embodiments of the invention is intended to be read in connection with the accompanying drawings, which are to be considered part of the entire written description of this invention. The drawings are not necessarily to scale, and certain features of the invention may be shown exaggerated in scale or in somewhat schematic form in the interest of clarity and conciseness.

Figure 1:
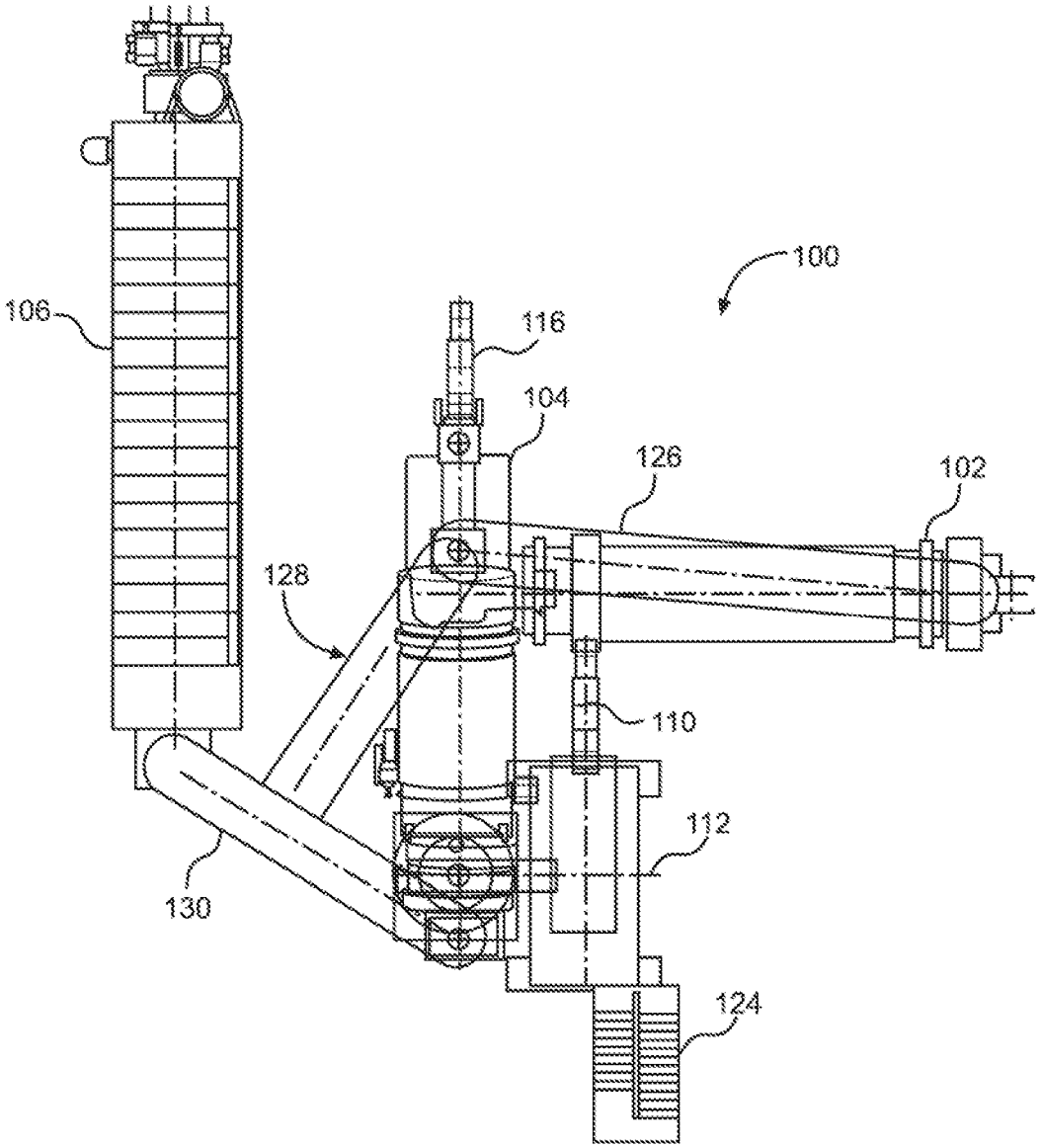
FIG. 1 (Prior Art)
FIG. 1 is an overhead view of a conventional production plant for the batch production of asphalt concrete using ACC.
Figure 2:
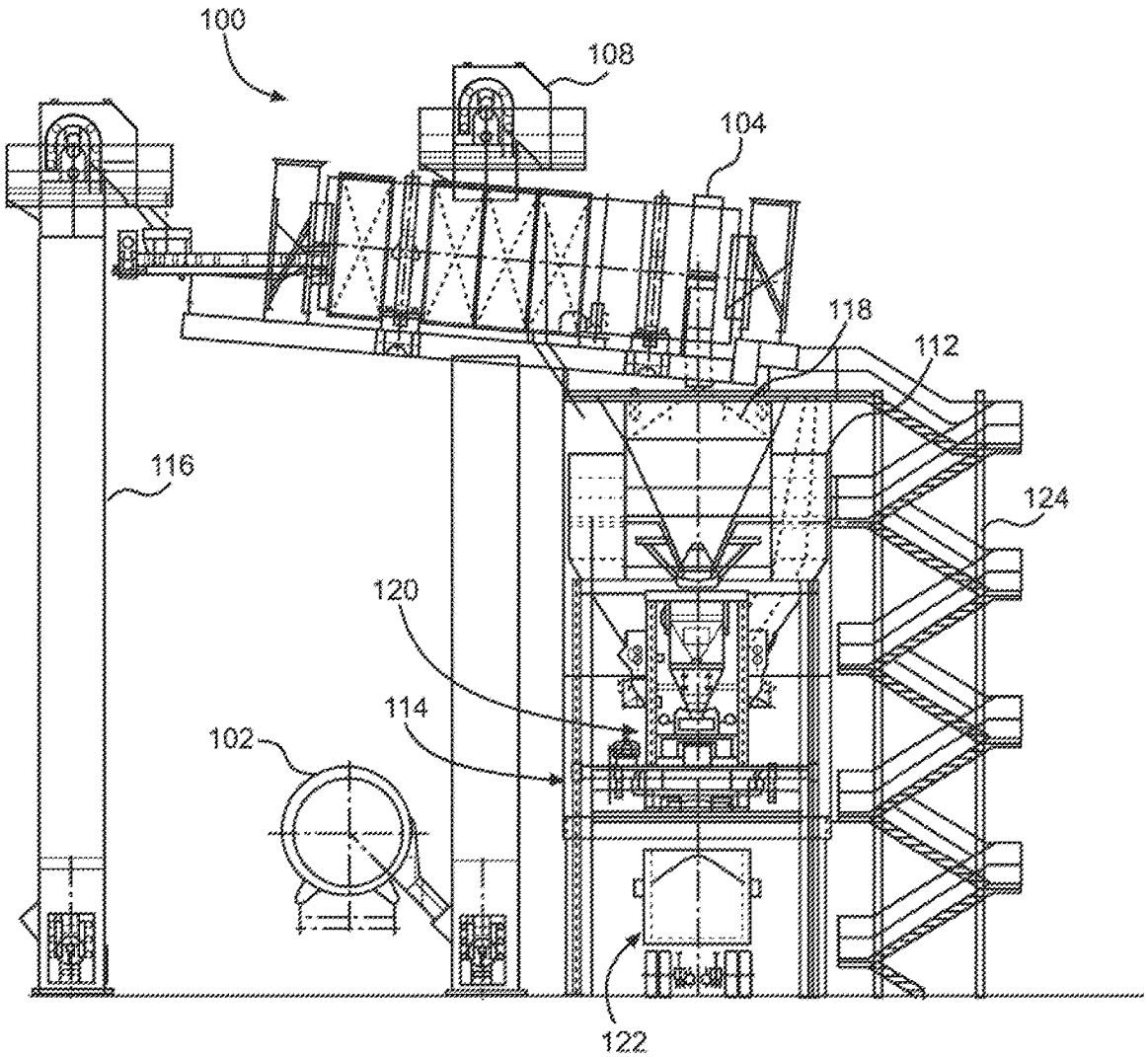
FIG. 2 (PRIOR ART)
FIG. 2 is a first side elevation view of the production plant depicted in FIG. 1.
Figure 3:
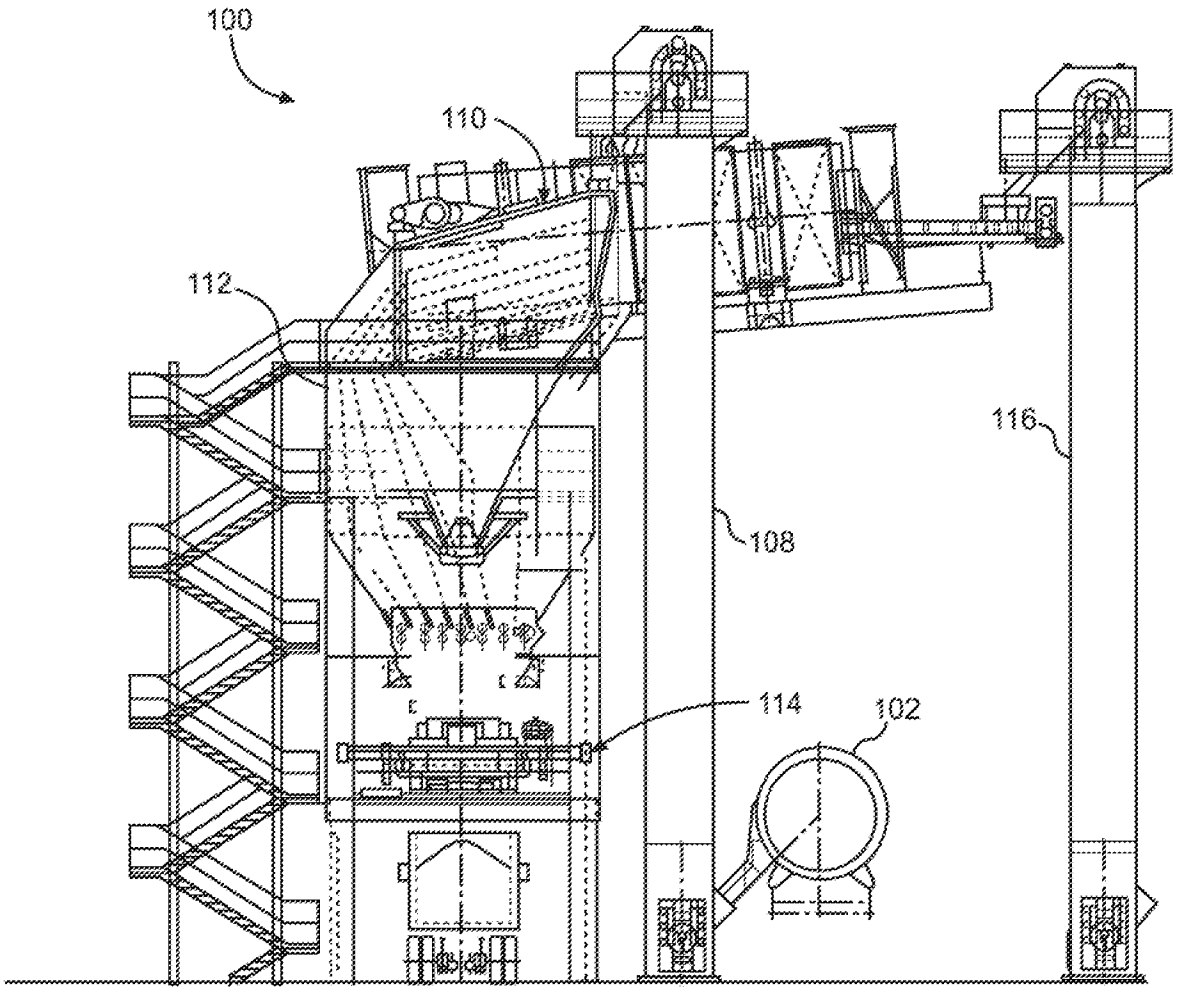
FIG. 3 (PRIOR ART)
FIG. 3 is an opposing side elevation view of the production plant depicted in FIG. 1.
Figure 4:
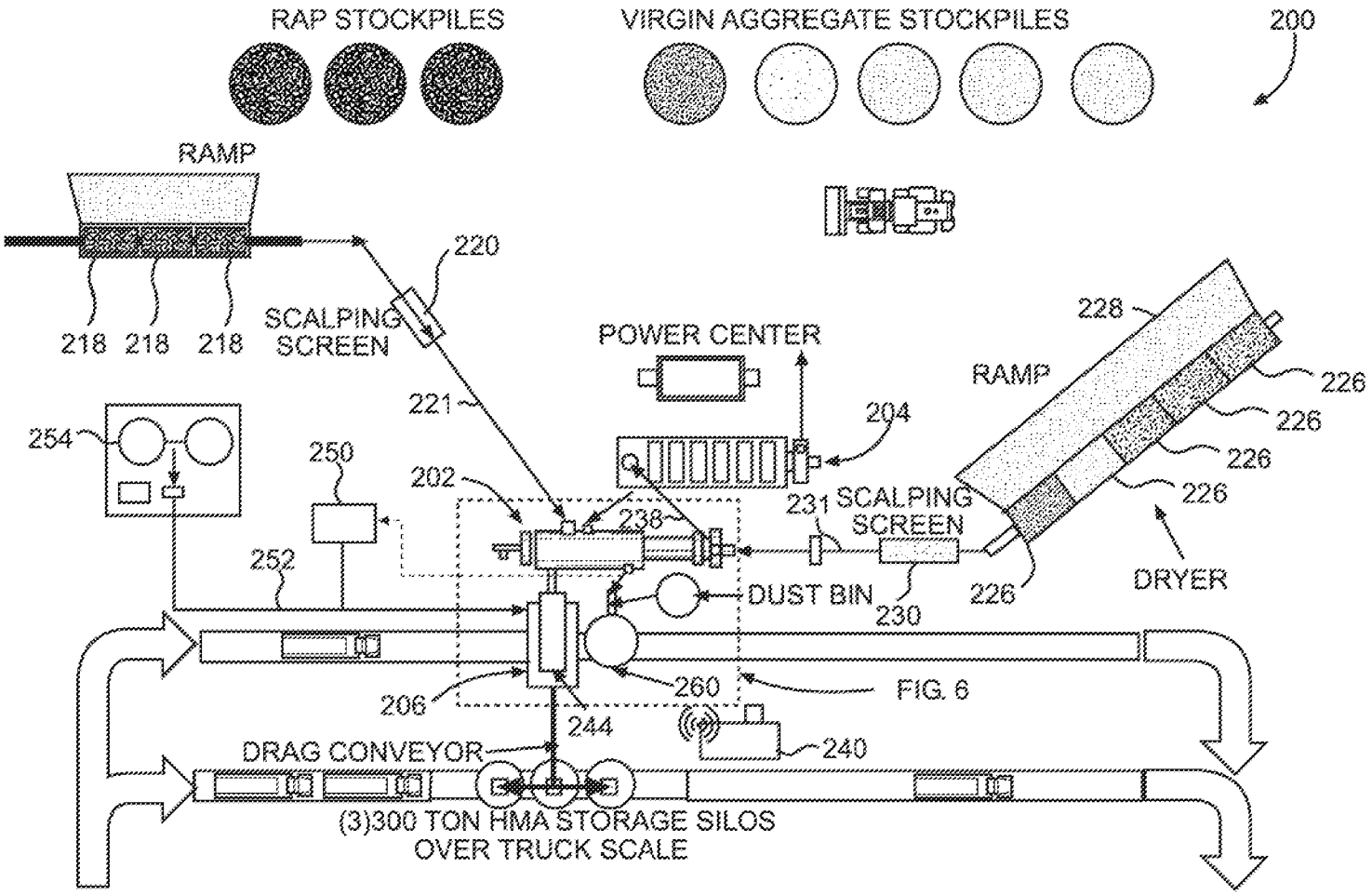
FIG. 4 is an overhead diagrammatic view of a production plant for the batch production of asphalt concrete using ACC according to a first embodiment of the present invention.

Referring now to FIG. 4, there is provided a production plant 200 for the batch production of asphalt concrete blends having a high percentage of ACC according to a first embodiment of the present invention. In this particular case, plant 200 is a Hi-RAP batch plant that produces up to 400 tons of asphalt concrete per hour utilizing approximately 65% RAP (or ACC) by weight. In this particular case, plant 200 includes a single and only dryer 202, a 76,000 cubic feet per minute (cfm) baghouse 204, and batch tower 206. Dryer 202 is preferably a DOUBLE BARREL® brand Model XHR dryer, depicted in FIG. 5, which is sold by Astec, Inc. of Chattanooga, Tenn. Dryer 202 is preferably located at ground level to facilitate access for maintenance, etc. The dryer 202 includes a generally cylindrical fixed outer drum 208 mounted on an inclined frame 270 that is preferably sized and configured to enable ground access to the dryer such that repairs and maintenance activities can be carried out from the ground. The dryer 202 includes a heating chamber that is located within a generally cylindrical inner drum 210 that is adapted to rotate with respect to the outer drum. The inner drum 210 is rotatably mounted on the frame by a plurality of bearings and is driven to rotate by a suitable drive system. Preferably, this drive system comprises a variable frequency drive that is adapted to vary the rotational speed of inner drum 210 with respect to outer drum 208. The above-described frame, bearings, and drive system are conventional components known to persons of skill in the art and, therefore, are not shown or described in detail. A burner 212 located at lower end 214 of the dryer 202 (on the left side as viewed in FIG. 5) directs a flame 216 in a generally axial direction into the interior of inner drum 210. Burner 212 may be equipped with a variable frequency drive that is adapted to vary the amount of excess air in burner as well as its firing rate. Such variable frequency drives are described in U.S. Pat. No. 8,863,404 (incorporated herein by reference).

ACC is delivered from one or more ACC supply bins 218 (FIG. 4) into the outer drum 208 of dryer 202 after passing through a scalping screen 220 to remove oversized material, by belt conveyor 221 or other similar conveyance means, through chute 222 into mixing chamber 224 between the outer drum 208 and inner drum 210, where it is heated. As discussed earlier, production facilities that have been conventionally used to produce asphalt concrete from aggregate materials that include a high percentage of ACC often utilize a pre-dryer for ACC, which directly exposes the ACC to the flame and burner which causes a number of safety and maintenance issues. However, in this case, since there is preferably no pre-dryer and the ACC is located only (i.e., exclusively) within the mixing chamber 224 of the dryer 202, it is never directly exposed to flame 216 or to the burner 212 itself. Instead, the ACC is only indirectly heated, which limits the risk that the liquid asphalt cement in the ACC will oxidize, reduces the risk of fire, and also limits fouling that occurs at the burner from ACC fines.

Virgin aggregate is delivered from one or more aggregate supply bins 226 of a bin coldfeed system 228 into the inner drum 210 of dryer 202 after passing through a scalping screen 230, by belt conveyor 231 or other similar conveyance means, through chute 232 located at upper end 234 of the dryer, whereupon it is dried and heated. The ACC supply bins 218 and the aggregate supply bins 226 of the bin coldfeed system 228 are each preferably equipped with a variable speed feeder that can control the discharge of material from the bin onto conveyors 221, 231, respectively.

The interior of the inner drum 210 is functionally separated into a combustion zone located in the vicinity of burner flame 216 and a drying zone located between the combustion zone and the upper end 234 of dryer 202. Because upper end 234 of dryer 202 is elevated above lower end 214, the virgin aggregate delivered into the interior of the inner drum 210 through chute 232 will move towards the lower end and is dried and heated as the inner drum rotates. Preferably, inner drum 210 includes a plurality of V-flights (not shown), such as are described and shown in U.S. Pat. No. 8,863,404, on its inner surface to facilitate this heating and drying process. Combustion products and exhaust gases generated during the operation of dryer 202 rise out of the inner drum 210 through exhaust gas outlet 236 and are conveyed to baghouse 204 (FIG. 4) by conduit 238. The baghouse 204 is operated in a conventional manner to process the exhaust gases from the dryer 202. Preferably, a controller (not shown, but described in U.S. Pat. No. 8,863,404, and located in control center 240) is adapted to control the temperature of the exhaust gases from dryer 202 that pass through exhaust gas outlet 236 by regulating variable frequency drive systems on inner drum 210 and burner 212.

Figure 5:
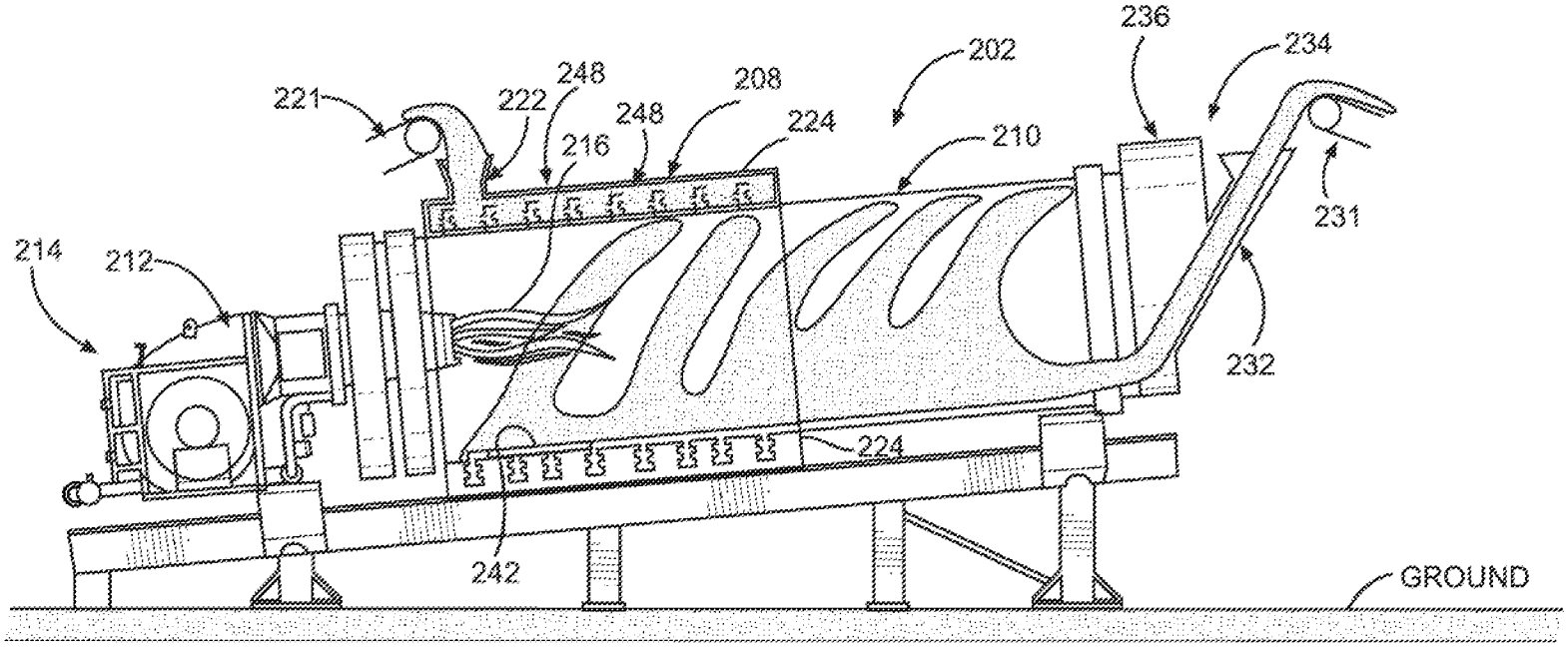
FIG. 5 is a sectional view of a direct dryer used in the production plant of FIG. 4.
Figure 7:
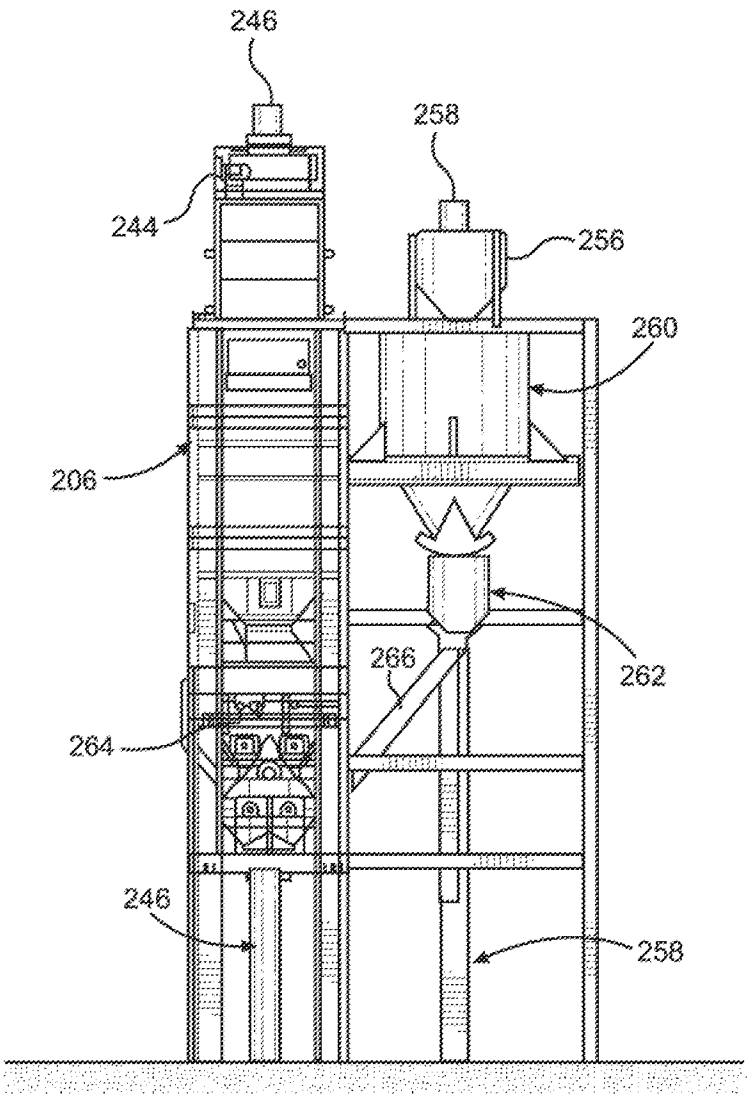
FIG. 7 is a side elevation view of a portion of the production plant shown in FIG. 4.
Figure 6:
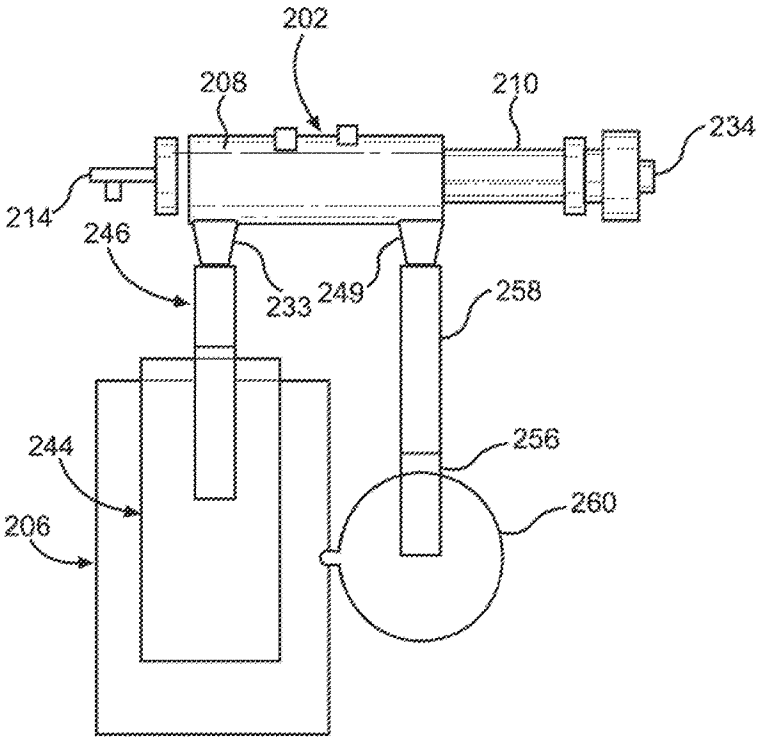
FIG. 6 is an enlarged view of the boxed portion of the production plant shown in FIG. 4 identified as "FIG. 6"

With continued reference to FIG. 5 and with further reference to FIGS. 6 and 7, a slide gate 242 that is selectively movable between a closed position and an open position is preferably located at the lower end of inner drum 210. When the slide gate 242 is in the closed position, the plant 200 operates in a first mode of operation where virgin aggregate that is delivered to the inner drum 210 via chute 232 does not enter the mixing chamber 224. Instead, the virgin aggregate passes out of the inner drum 210 of the dryer 202 through outlet 233 and then is conveyed vertically to a screen 244 located on top of the batch tower 206 (which is a 400 ton per hour high-RAP batch tower in this particular case) by way of a bucket elevator 246 or other similar conveyance means. The virgin aggregate is then held and kept hot in temperature-insulated hot bins located within the batch tower 206 until ready for introduction into the final asphalt concrete blend.

On the other hand, when the slide gate 242 is in the open position, the plant 200 operates in a second mode of operation where an aggregate mix formed by combining virgin aggregate together with ACC may be produced within dryer 202. More particularly, virgin aggregate may pass from inner drum 210 through open slide gate 242 and into mixing chamber 224 to be mixed with heated ACC material located there to form an aggregate mix. Inner drum 210 supports a plurality of mixing paddles 248, which extend away from an outer surface of the inner drum into mixing chamber 224. ACC delivered into mixing chamber 224 through chute 222 is thoroughly mixed with the virgin aggregate by mixing paddles 248 to form an aggregate mix. In certain preferred embodiments, the aggregate mix is comprised of up to 70% ACC. Asphalt cement may be injected into the aggregate mix within the dryer 202. However, in certain preferred embodiments, no additional asphalt cement is injected into the aggregate mix inside of the dryer 202. Rather, as discussed below, additional asphalt cement is injected into the aggregate mix within a mixer, such as a pugmill or continuous rotary mixer 250 (shown in FIG. 4), to form the final asphalt concrete blend.

In certain embodiments, the blend produced by the dryer 202 is the final asphalt concrete blend and no further processing is required. However, in other embodiments, the blend proceeds from the dryer 202 for further processing. For example, referring again to FIGS. 4 and 6, the aggregate mix may be conveyed from outlet 249 into rotary mixer 250, where it is further mixed with asphalt cement that is delivered to the mixer through supply line 252 from asphalt cement storage 254, which is comprised of two 30,000 gallon tanks in this particular case. The combination of dryer 202 and rotary mixer 250 is preferably a DOUBLE BARREL® brand Model DBXHR dryer with mixer that is sold by Astec, Inc. of Chattanooga, Tenn. In still other cases, as discussed further below, the aggregate mix is transported from dryer 202 to batch tower 206 for further processing, which may include further blending with virgin aggregate and the injection of asphalt cement. In each case, however, all drying and heating of the aggregate mix preferably occurs within the dryer 202.

Figure 8:
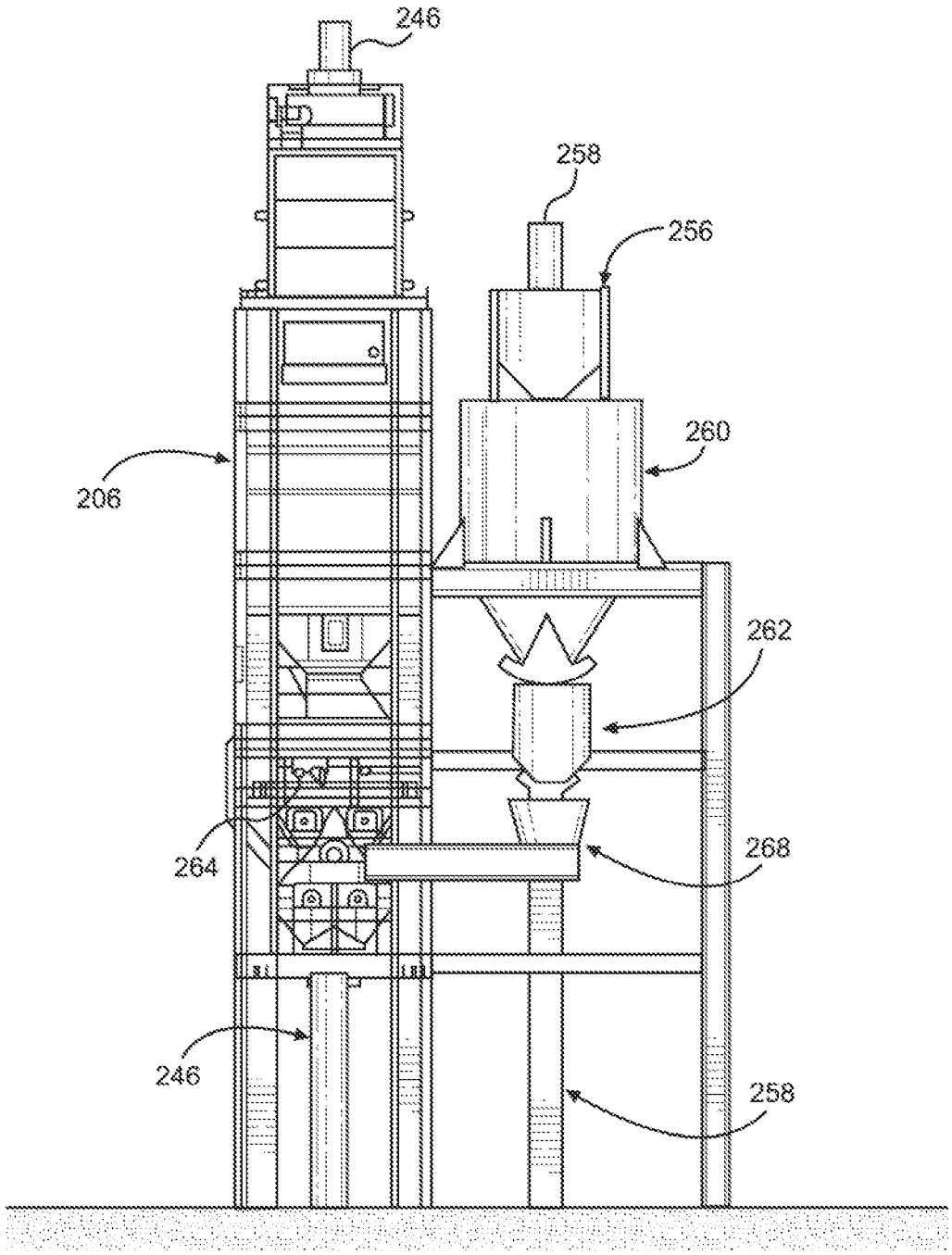
FIG. 8 is a side elevation view of a portion of a production plant for the batch production of asphalt concrete using ACC according to an embodiment of the present invention.

Referring again to FIGS. 6 and 7 and FIG. 8, when the dryer 202 is used to produce a aggregate mix of ACC and virgin aggregate, the aggregate mix may pass through the dryer 202 and then to batch tower 206. In particular, the aggregate mix exits the dryer 202 from 249 and is then conveyed vertically to a batcher 256 that is located near the top of the batch tower 206 by way of a separate bucket elevator 258 or other similar conveyance means. From there, the batcher 256 drops the aggregate mix into an insulated bin 260 in order to avoid segregation. In this particular case, the bin 260 is a 50-ton surge bin that is provided with 3-inch fiberglass insulation and an embossed aluminum skin to limit heat loss. However, the size of the bin 260 may vary according to the needs of the production plant 200. A weigh hopper 262 is positioned under the bin 260 to receive and weigh a quantity of the aggregate mix that is to be used in the next batch processed in the batch tower 206. The weighed quantity of aggregate mix is then directed into pugmill 264 within the batch tower 206 by way of gravity chute 266 (or via traverse conveyor 268, as shown in FIG. 8). Within the pugmill 264, the aggregate mix may be further combined with virgin aggregate that is stored in hot bins below screen 244, as discussed above, to form the final asphalt concrete blend. Thereafter, the aggregate mix and virgin aggregate may be further mixed with additional liquid asphalt cement that is delivered to the pugmill 264 through supply line 252 from asphalt cement storage 254 (shown in FIG. 4). In the end, the final asphalt concrete blend may be comprised of 0% ACC (i.e., 100% virgin aggregate plus asphalt cement) up to and including 100% ACC blend. Advantageously, the presently-disclosed methods and apparatus permit a Hi-RAP asphalt concrete blend to be produced using a single and only dryer 202 to carry out all heating and drying of the aggregate and ACC.

Thus, it may be seen that methods, systems, assemblies, facilities, and combinations of components according to the present general inventive concept, as described above, allow for the production of asphalt concrete from aggregate materials including a high percentage of ACC while using only a single dryer or a single dryer and a single mixer for both virgin aggregate and ACC, without using a separate pre-dryer for heating and drying ACC. Additionally, embodiments of the present invention, as described above, allow for ground access to the dryer, thereby making the frequent and routine maintenance of the dryer much faster and much safer. Furthermore, various embodiments of the present invention avoid injecting liquid asphalt cement within the dryer in order to reduce the maintenance interval. Instead, liquid asphalt cement is injected within a pugmill within a batch tower or within a separate rotary mixer.

Although this description contains many specifics, these should not be construed as limiting the scope of the invention but as merely providing illustrations of some of the presently preferred embodiments thereof, as well as the best mode contemplated by the inventor of carrying out the invention. The invention, as described and claimed herein, is susceptible to various modifications and adaptations as would be appreciated by those having ordinary skill in the art to which the invention relates.

What is claimed is:

1. A plant configured for the batch production of an asphalt concrete blend comprising a high percentage of asphalt cement components (ACC), the plant comprising:

a single and only dryer for mixing and for carrying out all drying operations required in producing the asphalt concrete blend by the plant, the single and only dryer having:

a drum;

a burner directing a flame in a generally axial direction into a heating chamber within the drum;

a mixing chamber in selective communication with the heating chamber;

means for preventing aggregate from passing from the heating chamber to the mixing chamber in a first mode of operation and for enabling aggregate to pass from the heating chamber to the mixing chamber in a second mode of operation;

a plurality of mixing paddles located within the mixing chamber that are sized and configured to mix ACC located within the mixing chamber; and an ACC chute through which ACC may be passed into the mixing chamber, wherein the plant is configured to produce an asphalt concrete blend having a high percentage of ACC.

2. The plant of claim 1 further comprising a frame that is sized and configured to mount the single and only dryer at ground level and at an angled orientation in order to provide an upper end and a lower end that is vertically lower than the upper end, wherein the ACC chute is located at the lower end of the single and only dryer and the aggregate chute is located at the upper end of the single and only dryer.

3. The plant of claim 1 wherein the plant further comprises: a slide gate located on the single and only dryer that is movable between a closed position, wherein the single and only dryer operates in the first mode of operation and virgin aggregate exits the single and only dryer after being dried and heated but without being mixed in the mixing chamber, and an open position, wherein the single and only dryer operates in the second mode of operation and aggregate passes from the inner drum through open slide gate and into mixing chamber.

4. The plant of claim 1 further comprising a source of liquid asphalt cement and a secondary mixer that is external to the single and only dryer that is configured to receive aggregate and ACC from the single and only dryer, to receive liquid asphalt cement from the liquid asphalt cement source, and to mix the aggregate and ACC with liquid asphalt cement in forming the asphalt concrete blend.

5. A method for producing an asphalt concrete blend comprising a high percentage of asphalt cement components (ACC), the method comprising the steps of:

providing a single and only dryer for mixing and for carrying out all drying operations required in producing the asphalt concrete blend, the single and only dryer having: a drum; a burner directing a flame into a heating chamber within the drum; and a mixing chamber in selective communication with the heating chamber;

operating the dryer in a first mode of operation in order to prevent aggregate from passing from the heating chamber to the mixing chamber;

operating the dryer in a second mode of operation in order to enable aggregate to pass from the heating chamber to the mixing chamber;

drying and heating aggregate in the single and only dryer without use of a pre-dryer; and combining asphalt cement with the aggregate such that the asphalt concrete blend has an ACC percentage of at least 25 percent.

6. The method of claim 5 further comprising the step of adding liquid asphalt to the asphalt concrete blend, wherein all of the liquid asphalt of the asphalt concrete blend is added to the asphalt concrete blend after the asphalt concrete blend is dried and heated by the single and only dryer.

7. The method of claim 6 wherein the liquid asphalt is added in a mixer that is external to the single and only dryer.

8. The method of claim 6 wherein the liquid asphalt is added in a batch tower that is external to the single and only dryer.

9. The method of claim 5 wherein the asphalt concrete blend is comprised of ACC and liquid asphalt cement.

10. The method of claim 5 wherein the aggregate is dried and heated via direct drying and heating in a first portion of the single and only dryer and, thereafter, the aggregate is combined with ACC and heated via indirect heating in a second portion of the single and only dryer.

11. The method of claim 10 wherein the combined aggregate and ACC are combined with liquid asphalt cement.

12. A method for producing asphalt concrete blends comprising the steps of:

providing a single and only dryer having:

a drum;

a burner directing a flame into a heating chamber within an interior of the drum;

a mixing chamber that is in selective communication with the heating chamber;

means for preventing aggregate from passing from the heating chamber to the mixing chamber in a first mode of operation and for enabling aggregate to pass from the heating chamber to the mixing chamber in a second mode of operation;

a plurality of mixing paddles located within the mixing chamber that are sized and configured to mix aggregate located within the mixing chamber;

heating and drying first aggregate within the heating chamber of the single and only dryer; and combining the first aggregate with asphalt cement to form a first asphalt concrete blend.

13. The method of claim 12 further comprising the step of providing a mixer that is external to the single and only dryer and combining the first aggregate with the asphalt cement in the mixer to form the first asphalt concrete blend.

14. The method of claim 12 wherein the first aggregate is combined with the asphalt cement in the mixing chamber to form the first asphalt concrete blend.

15. The method of claim 14, wherein the asphalt cement comprises asphalt cement components.

16. The method of claim 14 wherein the asphalt cement is liquid asphalt.

17. The method of claim 14 further comprising the step of providing a mixer that is external to the single and only dryer and combining the first asphalt concrete blend with liquid asphalt in the mixer to form a second asphalt concrete blend.

* * * * *